United States Patent [19]

Rolt

[11] Patent Number: 4,862,429

[45] Date of Patent: Aug. 29, 1989

[54] FLEXTENSIONAL ELECTROACOUSTIC TRANSDUCER WITH HYDROSTATICALLY COMPRESSION-LOADED DRIVER

[75] Inventor: Kenneth D. Rolt, Arlington, Mass.

[73] Assignee: Raytheon Company, Lexington, Mass.

[21] Appl. No.: 253,019

[22] Filed: Oct. 4, 1988

[51] Int. Cl.[4] ..... H01V 7/00

[52] U.S. Cl. ..... 367/165; 367/158

[58] Field of Search ..... 310/26, 334, 337, 338; 367/157, 158, 160, 162, 165, 167, 168, 172, 188

[56] References Cited

U.S. PATENT DOCUMENTS

| | | | |
|---|---|---|---|
| 1,525,823 | 2/1925 | Nicolson | 367/157 |
| 3,110,825 | 11/1963 | Miller | 367/158 |
| 3,325,780 | 6/1967 | Horan | 367/157 |
| 3,939,467 | 2/1976 | Cook et al. | 367/157 |
| 4,706,230 | 11/1987 | Inoue et al. | 367/159 X |

*Primary Examiner*—Brian S. Steinberger

*Attorney, Agent, or Firm*—Martin M. Santa; Richard M. Sharkansky

[57] ABSTRACT

A flextensional electroacoustic transducer with end plates and outwardly convex shells connected to form a housing containing a transduction drive member and laterally disposed tensioning members in contact with said end plates. The tensioning members are connected by hinges allowing rotational oscillatory movement of the end plates with respect to said hinges. Another embodiment includes end plate hinges where the end plates contact the transduction drive member and hinges where the shells connect to the end plates.

14 Claims, 3 Drawing Sheets

FLEXTENSIONAL ELECTROACOUSTIC TRANSDUCER WITH HYDROSTATICALLY COMPRESSION-LOADED DRIVER

BACKGROUND OF THE INVENTION

This invention relates to flextensional transducers and more particularly to a flextensional transducer in which hydrostatic pressure on the flexing portion of the transducer is coupled to the drive material so that the compressive stress originally introduced in the drive material at atmospheric pressure in a normal air environment is maintained or increased as the transducer is subjected to water pressure upon submergence.

In the prior art, the flextensional transducer 10 shown in the isometric view of FIG. 1 is comprised of a driver 11 which could be either a ceramic stack or magnetostrictive material each appropriately energized as known to those skilled in the art. A housing 12 comprising end portions 13 and flexing or shell portions 14 is arranged to provide compressional force on the driver 11 for reasons known to those skilled in the art. This compressive force is most commonly obtained by applying a transverse force to the shell portion 14 which elongates the separation between the ends 13. Insertion of the drive 11 between the elongated ends 13 is followed by release of the transverse force on the flexing sides 14 to result in a compressional force upon the drive 11. Alternatively, as is known to those skilled in the art, a threaded rod extending from one end 13 to the other end could be tensioned to provide a compression force upon the drive 11. The transducer is constructed with end panels not shown in FIG. 1 to provide a watertight enclosure generally containing air at atmospheric pressure when assembled. In operation, the transducer 10 is generally immersed in a substantial depth of water thereby creating inward pressure upon its shell portions 14 thereby reducing the compressional force being applied to the drive 11 in accordance with the depth of operation of the transducer. Therefore, the transducer design 10 of FIG. 1 is generally limited in its operating depth performance since a compressive force must always exist on the drive 11 to overcome the dynamic stresses induced by electromechanical drive.

Another prior art patent, U.S. Pat. No. 4,706,230, describes a structure which contains levers to magnify the expansion of the transduction material to obtain greater movement of the shell portions of the transducer. A rigid member supports the lever by acting as its fulcrum. Movement of the lever is accomplished by making its points of attachment to the transduction material, the shell, and the rigid member by connecting cantilevered members which flex or bend. The connecting members should have the conflicting desired properties of low bending stiffness with high longitudinal stiffness. Fatigue failure and noise generation are defects of the connecting members of this prior art patent. Water pressure-resisting properties of the transducer deteriorate if the strength of the connecting members is insufficient. When the strength is sufficient to resist the water pressure, the transducer acoustic performance is reduced because of the energy required to flex or bend the connecting members.

SUMMARY OF THE INVENTION

An object of this invention is to provide a structure which is an improvement over the structures of the prior art for providing a flextensional transducer capable of operating at high efficiency at substantial ocean depths without losing the compressive force on the drive element. A further object of the invention is to combine the preceding feature with the structure which allows the transducer to be smaller than heretofore available while having a prescribed resonance frequency, or alternatively, to obtain a structure of given size having a lower resonant frequency.

According to the invention, there is provided a flextensional transducer comprising a driver mechanism under compression at its end by the end portion of a flextensional transducer having flexing side walls. A hinged tensioning member attached to the ends on both sides of the drive means provides a lever mechanism by which pressure provided to the outside surface of the flexing sides of the transducer produces a greater compressive force on the drive means thereby eliminating the problem of prior art designs in which pressure reduced the compressive force on the drive.

BRIEF DESCRIPTION OF THE DRAWINGS

The aforementioned aspects and other features of the present invention will be apparent from the following description taken in conjunction with the accompanying drawings wherein.

DESCRIPTION OF THE PREFERRED EMBODIMENTS

Figure 2:
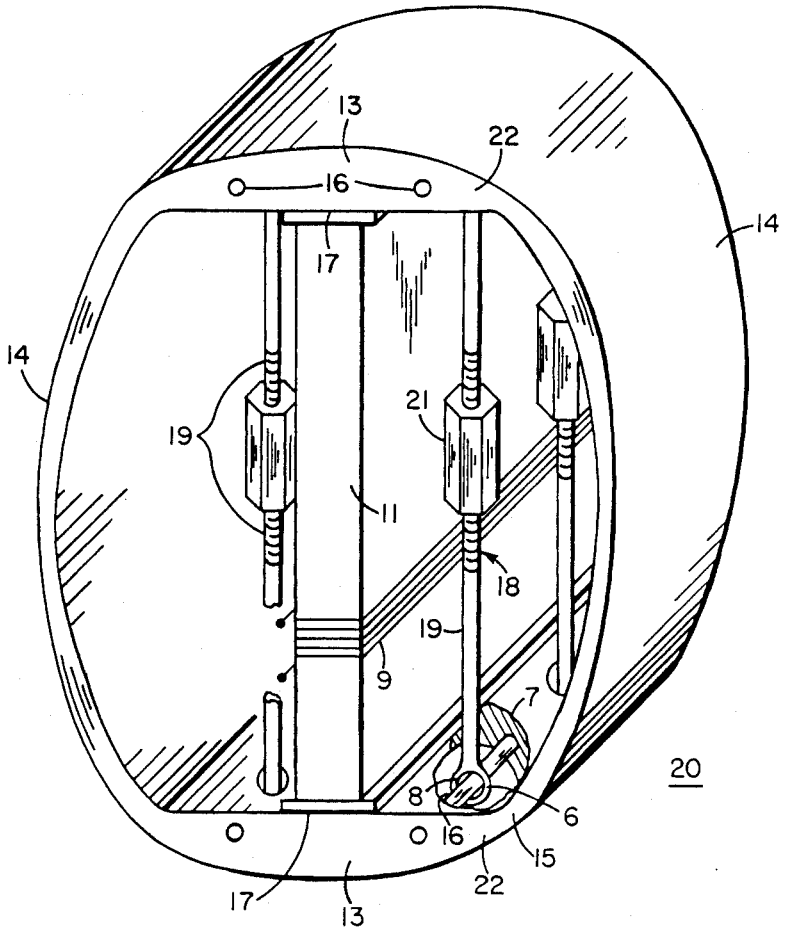
FIGS. 2 and 3 are isometric views of different embodiments of this invention.

Referring now to FIG. 2 there is shown one embodiment of the transducer 20 of this invention. The transducer 20 comprises a transduction member or drive 11, ends 13 in contact with the ends of drive 11, and shell portions 14 connected to the outer ends 15 of ends 13. Rods 16 are located in the ends 13 at positions intermediate the end region 15 and the region of contact 17 of drive 11 with end 13. A tensioning member 18 is connected at its ends to the rods 16. The tensioning 18 may be a turnbuckle having threaded rods 19 threaded into tightening nut 21. The ends of the rods 19 are formed at their ends to have an eye or a circular opening 6 through which the rods 16 pass thereby forming rotatable hinges 8 shown in the cutaway 7 of end 13. Tightening of the nut 21 on the threaded rods 18 produces an inwardly directed force on the rods 16 which, in turn, react upon the ends 13 to provide a compressive force on the drive 11 and shell 14. The tensioning member 18 is constructed such that it is relatively inelastic under forces imposed upon it by the ends 13.

In operation, an electrical signal is applied to coil 9 surrounding drive 11 shown as a magnetostrictive material, such as Terfenol D, to cause alternate contraction and expansion of drive 11 in response thereto. Drive 11 could alternatively be an electrostrictive material such as a ceramic. Longitudinal expansion of the drive 11 causes the portion of the end 13 in region 17 to move that portion of end 13 in an outward direction. The hinge 8 acts as a fulcrum by preventing movement of end 13 at hinge 8 and thereby causing the end portion 22 of end 13 to move in the opposite (or inward) direction toward the interior of the transducer 20. The curved shell portion 14 having a convex curvature as viewed from the outside of the transducer 20 is caused to become more convex by the inward movement of the end portions 22 to thereby provide a compressive force upon the water medium surrounding the transducer 20 when in operation. Conversely, contraction of the drive means 11 causes the shell 14 to become less convex to produce a rarefaction of the water surrounding transducer 20.

Figure 1:
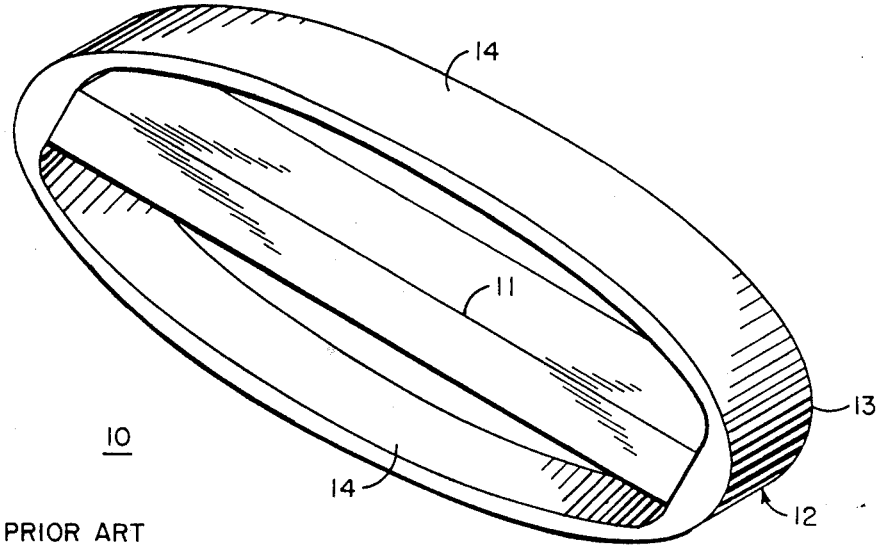
FIG. 1; is an end view of a prior art flextensional transducer.

It will thus become apparent that the transducer 20 when lowered into the ocean depths where it is exposed to the pressure of the water will cause an inward force upon the flexible shell 14 causing the end portion 22 of end 13 to move outwardly from the interior of the transducer 20. This outward motion of end portion 22 is converted by the lever action around the fulcrum rod 16 to produce an inward motion of the portion 17 of end 13. This inward motion of portion 17 increases the compressive force on the drive 11 thereby avoiding the problem produced in the prior art transducer 10 of FIG. 1 wherein increased water pressure reduced the compressive force upon the drive 11.

In all the embodiments of this invention as known by those skilled in the art, end plates with sealing gaskets are attached to the open ends of the transducers to provide a watertight compartment within the transducer thereby allowing the shell portions 14 to compress the air contained within the transducers with minimum expenditure of energy.

Figure 3:
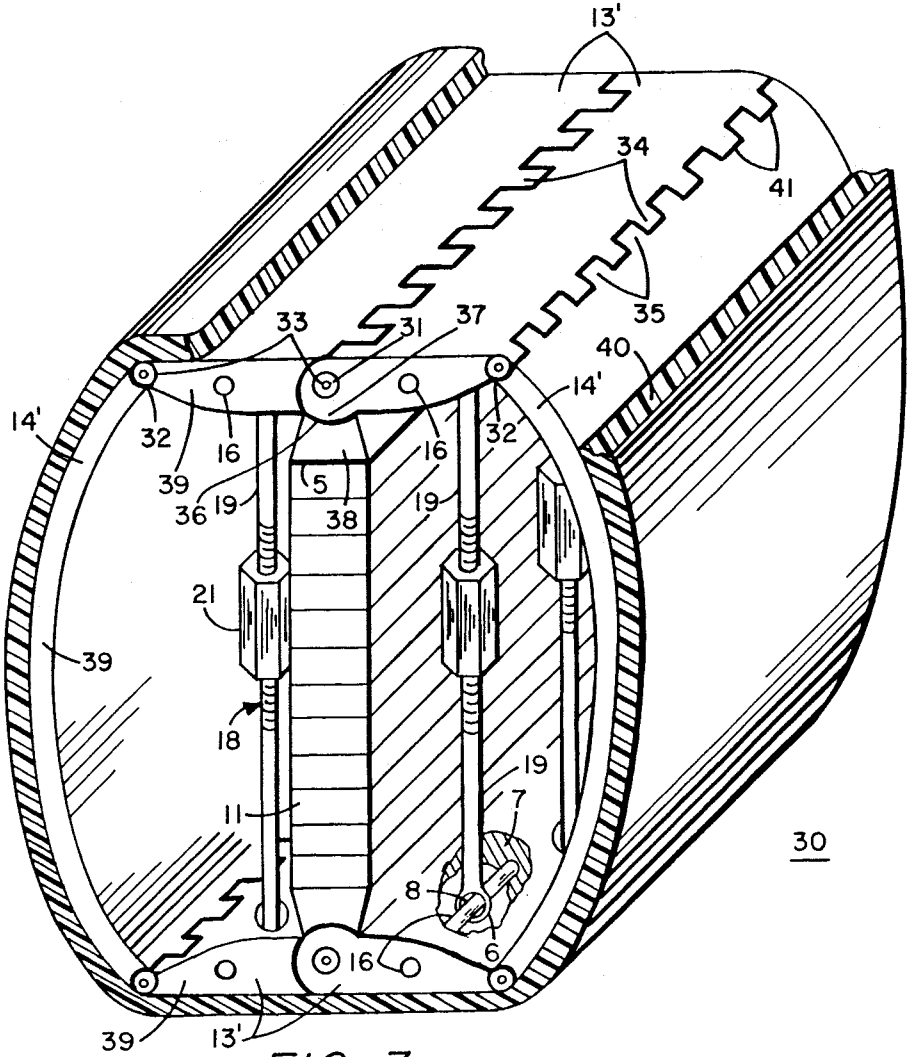

Another preferred embodiment of the invention is shown in FIG. 3. The transducer embodiment 30 of FIG. 3 is similar to that of FIG. 2, however, it contains several features not to be found in FIG. 2 which improve its capability in terms of its resonance frequency and in reducing the mechanical losses which occur in the embodiment of FIG. 2. The losses referred to in the embodiment of FIG. 2 result from the work which must be done by the drive 11 in causing bending of the ends 13 in the regions 17 and 22 under ordinary operating conditions where the drive 11 is energized to cause flexing of the shell 14.

In the transducer embodiment 30 of FIG. 3, the ends 13 of FIG. 2 have been divided into two half ends 13' which are connected to each other by the hinge 31. The other end of each of the ends 13' is connected to shell portions 14' by hinges 32. One embodiment of the hinge 32 comprises a pin 33 which extends through concentric holes in the nuckles 34 of the ends 13' and the intertwined nuckles 35 of the shell portions 14'. Hinge 31 is similarly constructed of a pin 33 and intertwined nuckles 34 of the ends 13'. Intermediate the hinges 31, 32 of each of the ends 13', there is located a hinge 8 comprising rod 16 and circular opening 6 at the end of rod 19 which connects the tensioning member 18 to ends 13' to allow slight rotational movement of end 13' relative to member 18. As described earlier, member 18 may comprise threaded rods 19 upon which the nut or turnbuckle 21 is threaded. Tightening turnbuckle 21 cause the ends 13' to compress the drive 11 and also to make the convex shell portions 14' more convex. Since the ends 13' which are joined by the hinge 31 will experience rotational motion relative to one another and relative to drive 11 as a result of electrical energization of the ceramic stack drive 11, it is desirable to provide a rotational joint 36 below hinge 31 by having the inner portion of the ends 13' at the location of the hinge 31 form protrusions 37 which mate with a concave plate 38 having a flat portion in contact with electrical insulating material 5 to isolate drive 11. Alternatively, the ends 13' may have a depression at the hinge 31 extending in the direction of pin 33. The depression would then mate with an end cap 38 having a corresponding protrusion.

In operation, electrical energization of the drive 11 causes alternate inward and outward movement of the hinge 31 which, in turn, causes rotational motion of the ends 13' about the rod 16 forming part of hinge 8. The motion of the ends 13' at the hinge 31 is translated by movement about the fulcrum point provided by the hinge 8 into an opposite inward or outward motion at the hinge 32. Each end 13' acts like a lever with a fulcrum at hinge 8. The inward or outward motion at the hinge 32 causes the convexity of the shell portion 14' to become more convex or less convex, respectively, so that when the transducer 30 is immersed in water, the motion is converted into compressional changes in the water surrounding the transducer. The concave plate 38 at the end of drive 11 keeps the drive 11 centered on the hinge 31 when under the compressive stress produced by tension member 18. End plates with gaskets (not shown) are secured to the edges 39 of transducer 30 to make it watertight for reasons discussed previously. To make the transducer watertight, it is also necessary to seal the hinges 31, 32. This may be accomplished by a rubber boot or cover 40 which covers the periphery of transducer 30 thereby sealing the space between the nuckles 34 and 35 of the hinges 31, 32. Alternatively and with less mechanical efficiency, the space 41 between the nuckles may be filled with an elastomer such as rubber or a plastic to provide a watertight seal while still allowing relative motion of the ends 13' and the shells 14'.

The turnbuckle design of the tensioning member 18 of FIGS. 2 and 3 require that the tensioning be provided by turning the nut 21. Since it is desired that the tension produced by the plurality of tensioning members 18 be substantially uniform, it is necessary that the transducers of FIGS. 2 and 3 be designed to allow access to each of the nuts 21 including the most interiorly located nuts of the plurality of tensioning members 18 which are distributed along the rod 6.

Figure 4:
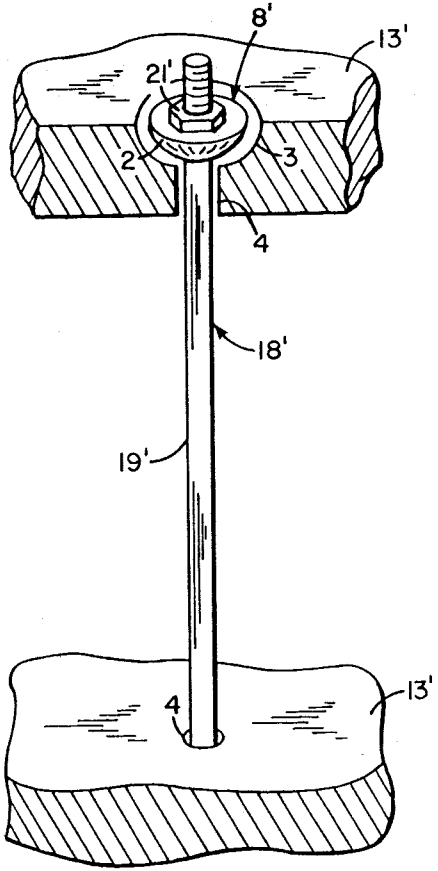
FIG. 4 is an alternative form of hinge for the tensioning member of FIGS. 2 and 3.

Because of the difficulty in reaching the most interior of the nuts 21, an alternate embodiment of a tensioning member 18' is shown in FIG. 4 in a partial sectional view of transducer 30. Tensioning member 18' has the feature that the tightening nuts 21' are located on the exterior surface of the transducer ends 13' with each of the tensioning nuts 21' being equally accessible. The tensioning member 18' is seen to comprise a threaded rod 19' which extends through the top and bottom ends 13'. The end 13' has a hole 4 concentric with a spherical or cylindrical depression 3 into which a partial spherical or cylindrical member 2 is in mating relationship. Rod 19' extends through hole 4 in end 13' and member 2 with its end in threaded engagement with the nut 21'. The hinge 8' thus formed is seen to be similar to the well-known ball joint. Another hinge 8' in contact with the lower end 13'' completes the tensioning member 18'. Tightening of the nut 21' will cause compression on the drive member 11 and shelis 14' as is desired. A plurality of similar tensioning members 18' is distributed along the length of the transducer in order to reduce the tension that must be produced by each tensioning member 18' and also to allow uniform distribution of compressive stress to be provided along the length of the drive member 11.

Having described a preferred embodiment of the invention, it will be apparent to one of skill in the art that other embodiments incorporating its concept may be used. It is believed, therefore, that this invention should not be restricted to the disclosed embodiment but rather should be limited only by the spirit and scope of the appended claims.

What is claimed is:

1. A flextensional electroacoustic transducer comprising:
a transduction member;
a tensioning member;
a housing containing said transduction and tensioning members;
said housing comprising end portions and shell portions connected to each other to form said housing with said shell portions and said end portions opposite each other, respectively;
said transduction member being in rotational and compression contact with said opposite end portions; and
said tensioning member being rotationally hingedly connected to said opposite end portions between each said shell portion connections and said transduction member contact.

2. The transducer of claim 1 wherein said shell portions are outwardly convex.

3. The transducer of claim 1 wherein said housing end portions and shell portions are unitary.

4. A flextensional electroacoustic transducer comprising:
a transduction member;
a rigid member disposed on at least one side of said transduction member;
shell members having ends;
lever members having ends, each one end connected to one of the ends of said shell members;
said transduction member and one said rigid member being in rotational and compression contact with at least one said lever member;
said rigid member contact with said lever member being a rotatable hinge contact; and
said rigid member contact with said lever member being between said transduction member contact and said lever member end.

5. The transducer of claim 4 wherein said rigid member is a tension member.

6. The transducer of claim 5 wherein said rigid member is a turnbuckle comprising:
two threaded rods each having an aperture at one end of each rod and a threaded other end; and
a nut in threaded engagement with said threaded rods for tensioning said threaded rods against the rods which pass through the aperture of each of said threaded rods.

7. The transducer of claim 4 wherein said rotatable hinge contact comprises:
a rod in each said lever member; and
said rigid member having in each end thereof an aperture through which said rod passes to form said rotatable hinge.

8. The transducer of claim 4 wherein said rotatable hinge contact comprises:
said rigid member having an end capable of having rotational contact with a mating portion of said lever member; and
said rotatable hinge contact being capable of resisting tension force on said lever member by said rigid member.

9. The transducer of claim 4 wherein said rigid member is a tension member and said transduction member and said shell members are in compression contact with the levers to which said rigid member is connected.

10. The transducer of claim 4 wherein said shell members are convex.

11. A flextensional electroacoustic transducer comprising:
a transduction member;
a first and second lever rotatably connected by a first hinge to each other at a first end of said first and second lever;
a first shell having an end rotatably connected by a second hinge to a second end of said first lever;
a second shell having an end rotatably connected by a third hinge to a second end of said second lever;
said transduction member being in rotational and compression contact with said first hinge; and
first and second tensioning members rotatably attached to said first and second levers, respectively, between said first and second ends.

12. The transducer of claim 11 wherein said first and second shells are convex.

13. A flextensional electroacoustic transducer comprising:
a transduction member;
a plurality of tensioning members disposed on each side of said transduction member;
a housing containing said transduction and tensioning members;
said housing comprising end portions, first rotational-type hinges, and shell portions, each of said end portions being rotationally hingedly connected by one of said first hinges to one of said shell portions;
each said end portion comprising a first and second lever rotationally hingedly connected to each other by a second hinge;
a rotational joint;
said transduction member in compressive force contact with said second hinge through said rotational joint;
said tensioning members rotationally hingedly connected to one of said first and second levers by a third hinge of said first and second levers;
said third hinge being between said first and second hinges; and
said tensioning members being adapted to provide a tension force on said third hinge and a compressive force on said first and second hinges.

14. The transducer of claim 13 wherein said shell portions are outwardly convex.

* * * * *